US012435585B1

(12) United States Patent
Wang et al.

(10) Patent No.: US 12,435,585 B1
(45) Date of Patent: Oct. 7, 2025

(54) HYDRAULIC CONTROL APPARATUS AND METHOD FOR A DOWNHOLE TOOL

(71) Applicants: CNPC USA Corporation, Houston, TX (US); BEIJING HUAMEI, INC., Beijing (CN); CHINA NATIONAL PETROLEUM CORPORATION, Beijing (CN)

(72) Inventors: Jinjun Wang, Houston, TX (US); Chris Cheng, Houston, TX (US); Jiaqing Yu, Houston, TX (US); Hems Mada, Houston, TX (US); Kevin Waddell, Houston, TX (US); Xiongwen Yang, Beijing (CN); Xu Zhao, Beijing (CN); Ming Yi, Beijing (CN); Xin Zhang, Beijing (CN); Yanping Zhang, Beijing (CN); Yong Luo, Beijing (CN); Fuxiang Hou, Beijing (CN); Tito Zabala, Houston, TX (US)

(73) Assignees: CNPC USA Corporation, Houston, TX (US); Beijing Huamei, Inc., Beijing (CN); China National Petroleum Corporation, Beijing (CN)

( * ) Notice: Subject to any disclaimer, the term of this patent is extended or adjusted under 35 U.S.C. 154(b) by 0 days.

(21) Appl. No.: 18/803,182

(22) Filed: Aug. 13, 2024

(51) Int. Cl.
*E21B 23/00* (2006.01)
*E21B 10/32* (2006.01)

(52) U.S. Cl.
CPC ..... *E21B 23/006* (2013.01); *E21B 10/322* (2013.01)

(58) Field of Classification Search
CPC ..... E21B 23/006; E21B 10/322
See application file for complete search history.

(56) References Cited

U.S. PATENT DOCUMENTS

| | | | |
|---|---|---|---|
| 1,671,474 | A | 5/1928 | Jones |
| 7,143,847 | B2 | 12/2006 | Pia |
| 8,863,843 | B2 | 10/2014 | Wu |
| 8,936,099 | B2 | 1/2015 | Hu |
| 9,284,816 | B2 | 3/2016 | Radford |
| 9,394,777 | B2 | 7/2016 | Cheng et al. |
| 9,453,380 | B2 | 9/2016 | Hardin, Jr. et al. |
| 10,443,349 | B2 | 10/2019 | Evans et al. |

FOREIGN PATENT DOCUMENTS

| | | | |
|---|---|---|---|
| CN | 105888558 | A | 8/2016 |
| CN | 113153162 | A | 7/2021 |

*Primary Examiner* — Giovanna Wright
(74) *Attorney, Agent, or Firm* — Craft Chu PLLC; Andrew W. Chu

(57) ABSTRACT

The present invention is a hydraulic control apparatus that activates and deactivates a downhole tool, such as a reamer, at a desired downhole location in a borehole. The apparatus includes a piston, a housing, a coil spring, and a guide pin. The piston has a cam portion with a continuous slotted groove. There is a slide member and a force member within the slotted groove so that the piston moves longitudinally and rotationally within the housing according to the guide pin within the slotted groove. At the desired downhole location, drilling fluid pressure passes a pressure threshold to move a front outlet of the piston to an opened position past an end of the housing, while rotating the piston according to the slide member and force member in the slotted groove. The apparatus alternately extends and retracts the reamer by opening and closing the front outlet by hydraulic control.

20 Claims, 7 Drawing Sheets

HYDRAULIC CONTROL APPARATUS AND METHOD FOR A DOWNHOLE TOOL

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to drilling oil and gas wells. More particularly, the present invention relates to a hydraulic control apparatus and method for a downhole tool in a drilling operation. The downhole tool, such as a reamer, is activated at a downhole location within the wellbore by controlling fluid flow through the wellbore. Even more particularly, the present invention relates to a hydraulic control apparatus with a pressure threshold for activating the downhole tool.

2. Description of Related Art Including Information Disclosed Under 37 CFR 1.97 and 37 CFR 1.98

Drilling operations to discover and produce hydrocarbons require coordination between the operators on the surface and the equipment far below the surface. A borehole is drilled through a geological formation deep in the earth. Such boreholes are formed by drill string comprised of a drill bit connected to sections of long pipe or drill pipe. The drill string extends from the earth surface to the bottom of the borehole. Drill collars and drill pipe sections add length, weight and support along the drill string as the borehole deepens, and different types of drill bits cut into all types of rock formations and soil combinations. The drill bit is rotated so that the drill string advances through the geological formation, thereby forming the borehole. The drill bit is lubricated, and cuttings from the formation are flushed from the borehole by drilling fluid or drilling mud pumped from the surface at high pressure. The drilling fluid mud can flow through an internal passage in the drill string and out through the drill bit. The drilling mud then flows to the surface through the annular passage formed between the drill string and the cut formation borehole.

Besides the drill bit, there can be other tools along the drill string. A stabilizer can be a tool deployed to steady the drill string. There can be sensors for downhole conditions along the drill string. A reamer is another active cutting tool deployed in some boreholes, especially in super deep boreholes. The reamer has cutting blades that are retracted when travelling to the desired location within the borehole and extended, when enlarging the borehole at the desired location. FIG. 1 shows a prior art drill string 1 with a drill bit 2, a reamer 3, and a stabilizer 4. These tools at these locations within the borehole are controlled by the operators at the surface.

There are various patents and patent publications disclosing hydraulic control of downhole tools. U.S. patent Ser. No. 10/443,349, issued on 15 Oct. 2019 to Evans et al and U.S. Pat. No. 9,453,380, issued on 27 Sep. 2016 to Hardin Jr. et al disclose a control component with a slotted track or zig zag slot, guide pin, and rotary cam for opening and closing a flow path related to position of the reamer blades or other downhole tool. The slotted track on a cam is coordinated with opened and closed positions of a flow path. The complexity of the slotted track is variable. U.S. Pat. No. 8,936,099, issued on 20 Jan. 2015 to Hu, Jianbing, Chinese Publication No. CN113153162, published on 23 Jul. 2021 for Chen et al, and U.S. Pat. No. 1,671,474, issued on 29 May 1928 to Jones, Frederick William show the range from complex to simple slotted tracks.

As complexity increases, there are more stops and detours to be coordinated with different positions of rotary cam and the subsequent configurations possible for the reamer blades or other tool components. There are more options to control a different path along the slotted track. Various mechanics control the movement of the guide pin through the slotted track, including a ball seat valve or a pressure differential between drilling pressure from the surface and annular pressure from the bottom of the borehole. The pressure differential is by far the most common movement control of the guide pin through the slotted track of the prior art.

U.S. Pat. No. 7,143,847, issued on 5 Dec. 2006 to Pia, Giancarlo, Chinese Publication No. CN105888558, published on 24 Aug. 2016 for Wei, Xuecheng et al and U.S. Pat. No. 9,284,816, issued on 15 Mar. 2016 to Radford, Steven R. show similar complex paths of a slotted track and finer pressure control to guide along each path and rotate of the cam.

There is a need for a different hydraulic control system and method. A pressure differential is complicated and difficult to maintain. The ability to change the drilling pressure as pumped from the surface is the most reliable control, but the annular pressure of the backflow from the bottom of the borehole is must less predictable and stable. Especially with deep wells, ultra deep wells and subsea wells, the distance between the surface and the desired downhole location of the reaming is very large. The responsiveness to alter the pressure so far from the surface and the distance any pressure pulse or pressure adjustment must travel reduce the precision of control in prior art hydraulic systems. With the complex slotted tracks with big curvature, small curvatures, widened track width, and recesses, the navigation of the guide pin requires a high level of data collection, data processing, and sensitivity.

It is an object of the present invention to provide a hydraulic or fluid control system for activating and deactivating a downhole tool, such as a reamer.

It is an object of the present invention to provide a hydraulic control system for activating and de-activating a downhole tool by a pressure threshold.

It is another object of the present invention to provide a cam portion with a slotted groove and force member within the slotted groove.

It is still another object of the present invention to provide a spring as the force member within the slotted groove.

It is yet another object of the present invention to provide a slide member to direct a guide pin against the force member within the slotted groove.

It is yet another object of the present invention to provide a stop member to ensure that the slide member directs the guide pin against the force member within the slotted groove.

It is another object of the present invention to provide a slotted groove to prevent the slide member from misaligning with the guide pin within the slotted groove.

It is another object of the present invention to provide ventilation channels around the cam portion.

It is another object of the present invention to provide a lock ring to prevent accidental rotation and movement of the cam portion during deployment into the borehole.

It is still another object of the present invention to provide a filter to prevent blockage by sand and debris within the piston.

It is yet another object of the present invention to provide a front outlet to determine an activation pressure range or reaming pressure range.

These and other objectives and advantages of the present invention will become apparent from a reading of the attached specification, drawings and claims.

BRIEF SUMMARY OF THE INVENTION

Embodiments of the present invention include a hydraulic control apparatus for activating and deactivating a downhole tool, such as a reamer, at a downhole location in a borehole. The apparatus includes a piston, a housing, a coil spring, and a guide pin. The piston is longitudinally moveable along the axis of the housing and rotatably moveable within the housing. A front outlet on the piston is opened and closed for fluid flow into a chamber by longitudinally moving the piston back and forth within the housing while rotating. Fluid in the chamber activates or deactivates the downhole tool. For a reamer, activating is expanding the blades of a reamer and deactivating is retracting the blades of the reamer.

The apparatus is hydraulically controlled. When assembled and deployed into the borehole, the forces on the piston and coil spring are balanced. The front or upper side of the piston is under drilling fluid pressure from the surface, while the back or lower side of the piston is under annular pressure from the bottom of the borehole. When positioned at the desired downhole location for activating or reaming, drilling fluid pressure downward on the piston passes a pressure threshold to align the front outlet 30 with the chamber 12. The piston 20 moves longitudinally along an axis of the housing 40 while rotating. The front outlet at the front of the piston is now aligned with the chamber so as to allow a flow of drilling mud to enter the chamber and extend the reamer blades. Closing the front outlet by moving the piston back along the axis of the housing while rotating also closes the flow of drilling mud so as to retract the reamer blades. The apparatus can alternately extend and retract the reamer blades by opening and closing the front outlet.

Embodiments of the apparatus of the present invention include the piston being comprised of a front piston portion, a back piston portion, and a cam portion. Under non-reaming conditions, the hydraulic force on the piston is balanced. The drilling fluid pressure from the surface, the annular pressure from the bottom of the borehole, and the coil spring balance the position of the piston. A front distal end of the front piston portion has the front outlet. The housing can have a first housing end, a second housing end, and an interior chamber. The housing is a tubular member of suitable material for downhole conditions. The cam portion, the back piston portion, and at least a portion of the front piston portion are contained within the interior chamber.

In the present invention, the cam portion and the guide pin determine the movement and rotation of the piston relative to the housing. The cam portion and the guide pin determine when the front outlet is in the closed position or opened position. The guide pin is mounted to the housing and extended into the cam portion. The guide pin is fixed in position on the housing, while the cam portion moves and rotates relative to the guide pin and the housing.

Embodiments of the cam portion include an outer cam surface, a continuous slotted groove along the outer cam surface, a slide member, and a force member. The force member exerts force back and forth with the slide member. The slide member has a forward contact surface and a blocking surface adjacent to the forward contact surface. The force member can be comprised of a coil spring, Bellville or disc springs, a leaf spring, a plurality of leaf springs or other springs and resilient components.

Embodiments of the slotted groove include a first point, and the guide pin at the first point corresponds to the front outlet in the closed position. There is a first pathway from the first point to the forward contact surface of the slide member. When drilling fluid pressure from the surface exceeds a threshold, the guide member pushes on the forward contact surface of the slide member against the force member until the guide pin passes from the forward contact surface to the blocking surface. The force member is compressed when the threshold is exceeded. There is also a second pathway from the blocking surface of the slide member to a second point. The guide pin in the second pathway corresponds to the front outlet in the opened position. Embodiments of the slotted groove also have a third pathway from the second point to a third point. The guide pin in the third pathway corresponds to the front outlet switching from the opened position to the closed position. The guide pin at the third point is analogous to the first point so as to correspond to the front outlet in the closed position.

In embodiments of the slotted groove, the first point to the third point and the components within the slotted groove are modular and repeated around the cam portion. The front outlet can continuously be opened and closed to extend and retract the reamer blades, just like any other activation and deactivation of an alternate downhole tool. As the piston rotates within the housing and moves back and forth within the housing, the front outlet switches back and forth between the opened and closed configurations.

Other embodiments of the present invention include the cam portion having a peripheral cavity to house the force member. The slotted groove can also have a dovetail groove shape to prevent the guide pin and the slide member from dropping away or misaligning in the slotted groove. There can also be a locking key to prevent the slide member from compressing the force member too much and the guide pin from avoiding the move from the forward contact surface to the blocking surface, even if the amount of pressure overcomes the force member. Some embodiments also include the housing having ventilation channels around the cam chamber portion for fluid flow between the piston and the housing. Alternate embodiments can also include a locking ring with locking ring shear pins removably attached to the housing to prevent the piston from prematurely moving before reaching the desired downhole location in the borehole. There can also be a filter in fluid connection with the piston to prevent accumulation of sand and debris, which would interfere with movement of the piston.

The apparatus has modular features repeated through the slotted groove. There can also be another guide pin mounted to the housing and being cooperatively aligned with the original guide pin. Both guide pins will move through analogous sections of the slotted groove.

Embodiments of the present invention include a method for activating and deactivating a downhole tool at a downhole location in a borehole. A reamer is an example of the downhole tool, and the activating and deactivating corresponds to extending and retracting reamer blades. The method of the present invention includes deploying the apparatus with the front outlet in the closed position and the guide pin at the first point in the slotted groove to the desired downhole location in the borehole. At the downhole location, the method applies drilling fluid pressure on the cam portion so as to move the guide pin from the first point through the first pathway to the forward contact surface of the slide member. Then, the method includes applying the drilling fluid pressure over a pressure threshold set by the force member so as to slide the guide pin from the front contact surface to the blocking surface of the slide member and into the second pathway. The front outlet switches from the closed position to the opened position to activate the tool.

Embodiments of the method further includes moving the guide pin from the second point through the third pathway to the third point so as to switch the front outlet from the opened position to the closed position. With the front outlet in the closed position, the tool is deactivated. The steps of the method repeat, since the slotted groove is continuous around the cylindrical cam portion. The third point is analogous to the next first point of the next section of the slotted groove. The sections are modular, so the steps of the method are repeated for opening and closing the front outlet.

DETAILED DESCRIPTION OF THE INVENTION

The prior art hydraulic control devices already disclose both simple and complex zig zag slots circumscribed around a cam for continuous and repeated opening and closing of a valve to activate and de-activate a downhole tool, such as a reamer. These hydraulic control devices conventionally rely on manipulating the pressure differential between drilling pressure from the surface and annular pressure from the bottom of the borehole. The guide pin navigates the slot with the curves and widened slot areas and selects between multiple branches of pathways of the slot by a complicated process based on hydraulic flow rate, pressure profiles, and narrow real time windows. The reliability of real time data at the downhole location and limited tolerances of timing calculations at the surface reduce the reliability and resilience of the prior art hydraulic control devices. The present invention is a hydraulic control apparatus with a slotted track and components within the slotted track so that the guide pin movement is based on a pressure threshold, instead of a pressure differential. The sensitive and finicky calculation and manipulation of a pressure differential is replaced with a more robust and predictable switch to control a downhole tool.

Figure 1:
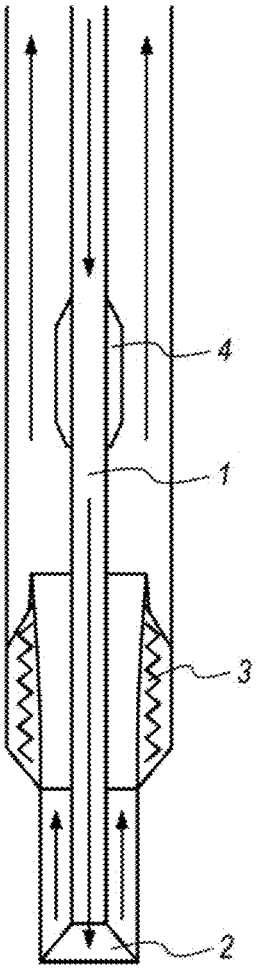
FIG. 1 Prior Art
FIG. 1 is a schematic view of a prior art control system for a downhole tool, such as a reamer.
Figure 2:
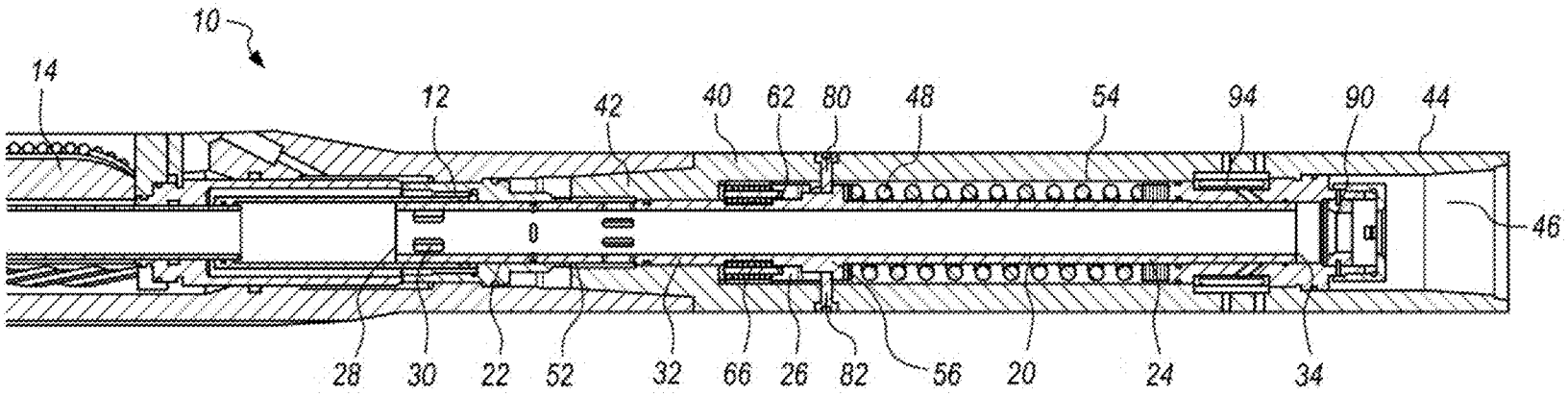
FIG. 2 is a sectional view of an embodiment of the hydraulic control apparatus, according to the invention and in an initially assembled or before first deployment with the switch closed.
Figure 3:
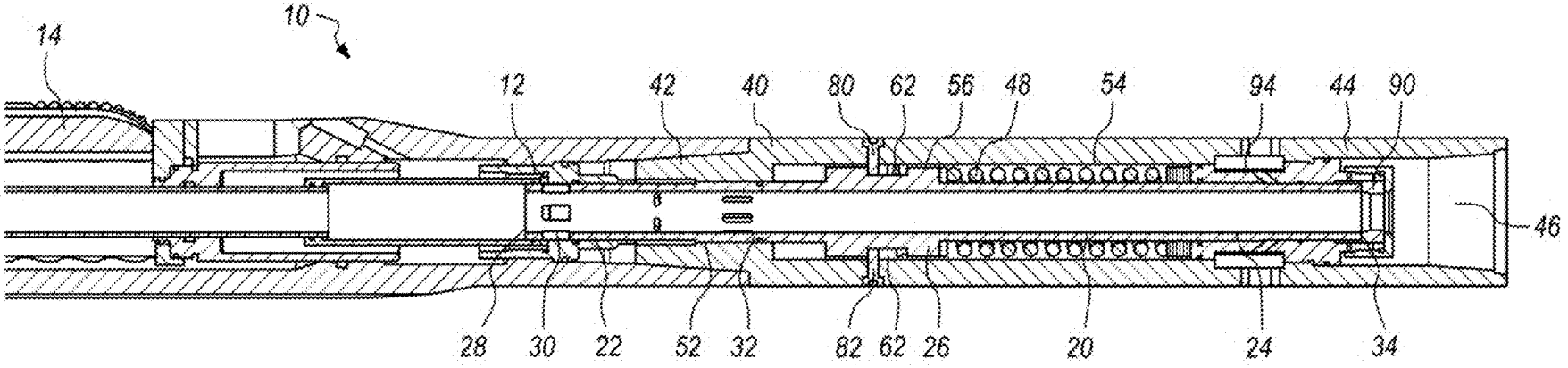
FIG. 3 is another sectional view of an embodiment of the hydraulic control apparatus, according to the invention with the switch opened.

The present invention is an apparatus 10 for activating and deactivating a downhole tool, such as a reamer, at a downhole location in a borehole by hydraulic control. As shown in FIGS. 2-14, the apparatus 10 includes a piston 20, a housing 40, a coil spring 48, and a guide pin 80. The piston 20 moves longitudinally within the housing 40 and also rotates within the housing 40. The piston 20 is longitudinally moveable along an axis of the housing 40 and rotatably moveable within the housing 40 around the axis of the housing 40. When assembled and deployed into the borehole, the forces on the piston 20 are balanced. The front or upper side of the piston 20 is under drilling fluid pressure from the surface, while the back or lower side of the piston 20 is under annular pressure from the bottom of the borehole. When positioned at the desired downhole location for reaming, drilling fluid pressure downward on the piston 20 passes a pressure threshold to move the piston 20 to align the front outlet 30 with the chamber 12. The piston 20 moves longitudinally along an axis of the housing 40 while rotating. FIG. 2 shows the closed position of the front outlet 30, and FIG. 3 shows the opened position of the front outlet 30 with the piston 20 moved toward the back of the housing 40. A front outlet 30 at the front of the piston 20 is now aligned with a chamber 12 so as allow a flow of drilling mud to enter the chamber and extend the reamer blades. Closing the front outlet 30 also closes the flow of drilling mud so as to retract the reamer blades. The apparatus 10 can alternately extend and retract the reamer blades by opening and closing the front outlet 30.

FIGS. 2-3 show the piston 20, housing 40, coil spring 48, and guide pin 80 of the apparatus 10, and the relationships between these components, according to embodiment of the present invention. The piston 20 is comprised of a front piston portion 22, a back piston portion 24 opposite the front piston end, and a cam portion 26 between the front piston portion 22 and the back piston portion 24. The front piston portion 22 and the back piston portion 24 have identical piston area. Under non-reaming conditions, the hydraulic force on the piston is balanced, independent of operation depth. The drilling fluid pressure from the surface, the annular pressure from the bottom of the borehole, and the coil spring 48 balance the position of the piston 20 longitudinally and rotationally relative to the housing 40.

The front piston portion 22 has a front distal end 28, and the back piston portion has a back distal end 34. The front distal end 28 has a front outlet 30 with an opened position and a closed position. FIGS. 2 and 3 show the movement of the front outlet 30 of the piston 20 relative to the chamber 12 for extending and retracting the reamer blades 14 of the reamer as the downhole tool. The front outlet 30 in the opened position corresponds to extending the reamer blades 14, and the front outlet 30 in the closed position corresponds to retracting the reamer blades 14.

The housing 40 can have a first housing end 42, a second housing end 44 opposite the first housing end 42, and an interior chamber 46 between the first housing end 22 and the second housing end 44. The housing 40 is a tubular member of suitable material for downhole conditions. The cam portion 26, the back piston portion 24, and at least a portion 32 of the front piston portion 22 of the piston 20 are contained within the interior chamber 46, as shown in FIGS. 2-3. FIG. 3 shows the longitudinal movement of the piston 20 toward the second housing end 44 for the opened position of the front outlet 30. With the coil spring 28, the downhole drilling pressure, and the annular pressure, the embodiment of this piston 20 shows longitudinal movement back into the housing 40 in order to align the front outlet 30 with the chamber 12.

An embodiment of the interior chamber 46 has a front chamber portion 52, a back chamber portion 54 opposite the front chamber portion, and a cam chamber portion 56 between the front chamber portion 52 and the back chamber portion 54. FIGS. 2-3 show the front piston portion 22 being moveable within the front chamber portion 52 and the cam chamber portion 56. FIGS. 2-3 also show the cam portion 26 of the piston 20 being moveable within the cam chamber portion 56. The back piston portion 24 is moveable within the back chamber portion 54 and the cam chamber portion 56.

FIGS. 2-3 also show the coil spring 48 around the back piston portion and in contact with the cam portion 26 so as to exert pressure back and forth against cam portion 26 of the piston 20. In response to annular pressure and drilling pressure from the surface, the coil spring 48 interacts with the piston 20. In particular, before any reaming by the downhole tool, the piston 20 can be balanced in the housing 40, according to the coil spring 48.

The cam portion 26 of the piston 20 and the guide pin 80 in the housing 40 determine the movement and rotation of the piston 20 relative to the housing 40. The cam portion 26 of the piston 20 and the guide pin 80 in the housing 40 determine when the front outlet 30 is in the closed position or opened position.

FIGS. 4-8 show embodiments of the cam portion 26 being comprised of an outer cam surface 60, a continuous slotted groove 62 along the outer cam surface so as to circumscribe the cam portion 26, a slide member 64 within the slotted groove 62, and a force member 66 in contact with the slide member 64. The force member 66 exerts force back and forth with the slide member 64. The outer cam surface 60 is cylindrical, and the slotted groove 62 extends along the entire outer cam surface 60 for a continuous route around the cam portion 26. The route is circuitous with zig zag patterns, widening of the route, and some pathways longitudinally parallel with the axis of the tubular cam portion 26. The slide member 64 has a forward contact surface 64A and a blocking surface 64B adjacent to the forward contact surface 64A. FIGS. 4-8 show a slant to the forward contact surface 64A, an edge with the blocking surface 64B, and a linear blocking surface 64B longitudinally aligned with the cam portion 26, in particular parallel to the axis of the cam portion 26.

Figure 4:
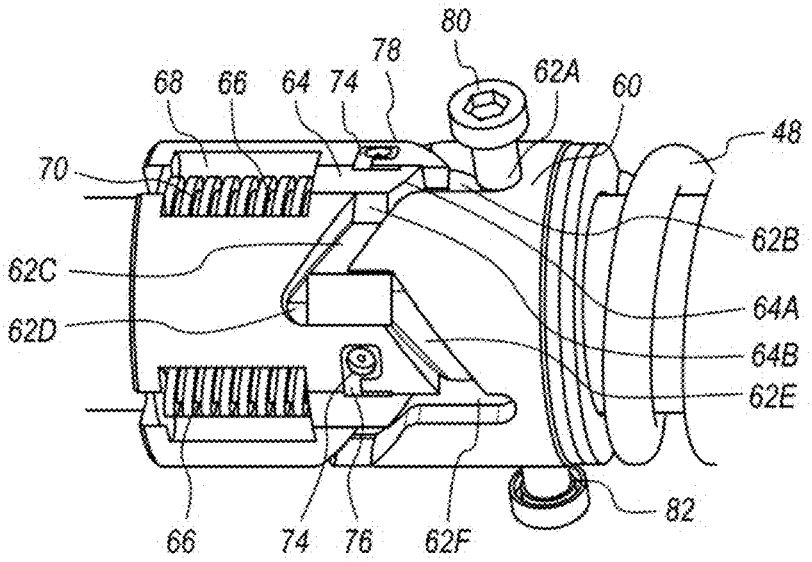
FIG. 4 is an enlarged perspective view of an embodiment of the cam portion of the piston with the guide pin at the first point, according to the present invention.
Figure 5:
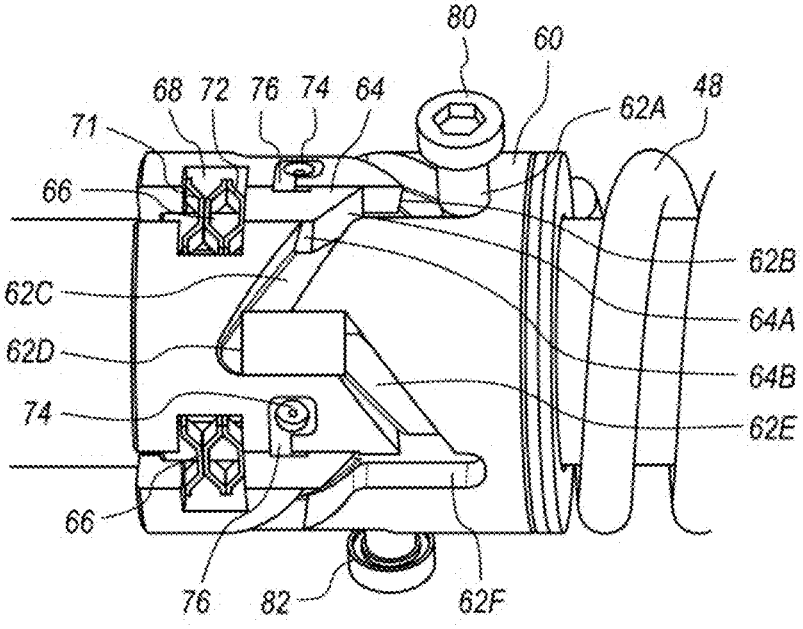
FIG. 5 is another enlarged perspective view of an embodiment of the cam portion of the piston with the guide pin at the first point, showing an alternate embodiment of the force member, according to the present invention.
Figure 6:
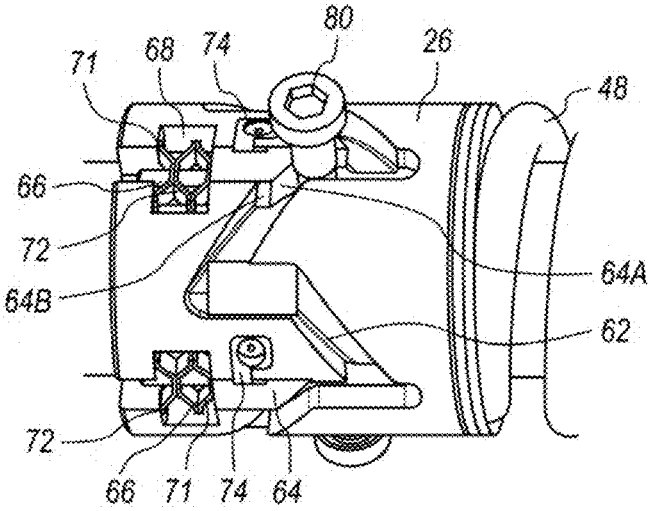
FIG. 6 is a perspective view of a portion of the hydraulic control apparatus, according to the present invention with the guide pin positioned in the first pathway, showing the embodiment of the force member of FIG. 5.

Embodiments of the force member 66 can be comprised of a coil spring 70 (FIGS. 2-4 and 7-8), Bellville or disc springs, a leaf spring 71, 72 (FIGS. 5-6) or a plurality of leaf springs 71, 72 (FIGS. 5-6). Other springs and resilient materials can be a force member 66.

Figure 9:
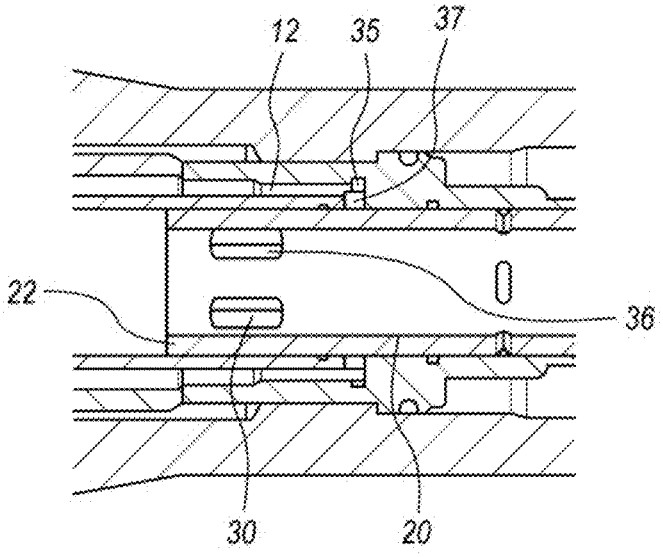
FIG. 9 is an enlarged sectional view of an embodiment of the front piston portion of the piston, according to the present invention with the front outlet in the closed position.
Figure 10:
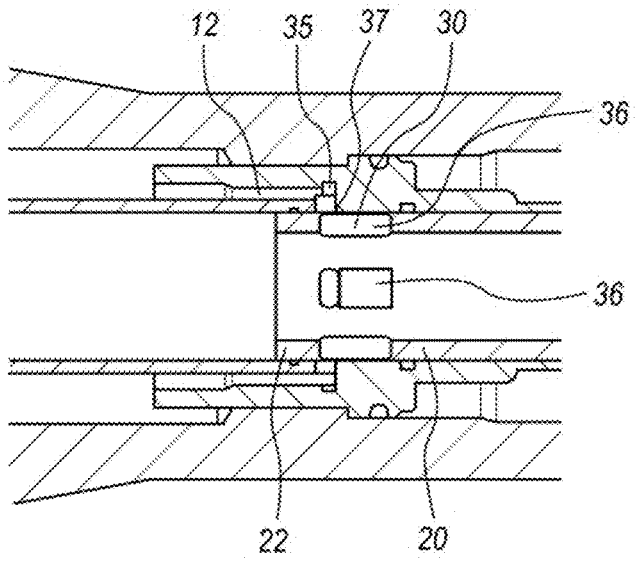
FIG. 10 is an enlarged sectional view of an embodiment of the front piston portion of the piston, according to the present invention with the front outlet in the opened position.

FIGS. 9-10 show an embodiment of the front outlet 30 being comprised of an elongated slot 36 or slide gate, a slide rod 37 removably extended into the elongated slot 36 in the opened position, and a die spring 35 connected to the slide rod 37 so as to determine an activation pressure range of the front outlet 30. When the downhole tool is reamer, the activation pressure range is the reaming pressure range. There is a need to activate and maintain the reaming activation at different ranges of pressure. When the front outlet 30 moves from closed position to opened position, there is an internal pressure drop as fluid begins to flow to the chamber 12 to open the blades 14. This initial drop is detected at the surface. The reaming starts at this dropped pressure. In some embodiments, the dropped pressure is a desired low reaming pressure needed to protect weak rock formations of the borehole. The desired low reaming pressure is lower than the threshold pressure. In this embodiment, the die spring 35 will extend the slide rod 37 through the elongated slot 36 of the front outlet 30 to hold the front outlet 30 in the opened position, even at the dropped pressure that is the desired low reaming pressure for a weak formation. The slide rod 37 or plurality of slide rods 37 can hold the corresponding elongated slots 36 of the front outlet 30 open. The flow pressure can be increased to continue the movement and rotation of the guide pin 80 relative to the cam portion 26 through the slotted groove 62, when the need for low pressure reaming is over. If the rock formation is strong and solid, the internal pressure as flow pressure can be increased immediately form the dropped pressure. The die spring 35 and slide rod 37 are not needed to hold the front outlet 30 open, since the flow pressure is already higher and high enough. The flow pressure can still be increased to continue the movement and rotation of the guide pin 80 relative to the cam portion 26 through the slotted groove 62, when the need for regular pressure reaming is over. For a reamer as the downhole tool, the embodiment of the front outlet 30 having the elongate slot 36, slide rod 37, and die spring 35 determine a reaming pressure range from the lower dropped pressure to the conventional higher pressure for reaming.

Embodiments of the guide pin 80 are shown in FIGS. 4-8 as mounted to the housing 40 and extended into the slotted groove 62. The guide pin 80 is fixed in position on the housing 40, while the cam portion 26 of the piston 20 moves and rotates relative to the guide pin 80 and the housing 40. FIG. 5 is a cross-sectional view with guide pin 80 as a screw or bolt fixed through a hole in the housing 40. The end of the guide pin 80 extends into the slotted groove 62.

The features of the slotted groove 62 include a first point 62A. The guide pin 80 is at the first point 62A in FIGS. 2, 5 and 6. The guide pin 80 at the first point corresponds to the front outlet 30 in the closed position. The apparatus 10 and tool, such as a reamer, are being assembled and deployed into the borehole. The apparatus 10 and the tool are traveling through the borehole to a desired downhole location that requires the action of the tool, i.e. reaming. FIG. 5 shows the alignment of the force member 66 and the slide member 64 to the first pathway 62B to encounter the guide pin 80.

Figure 7:
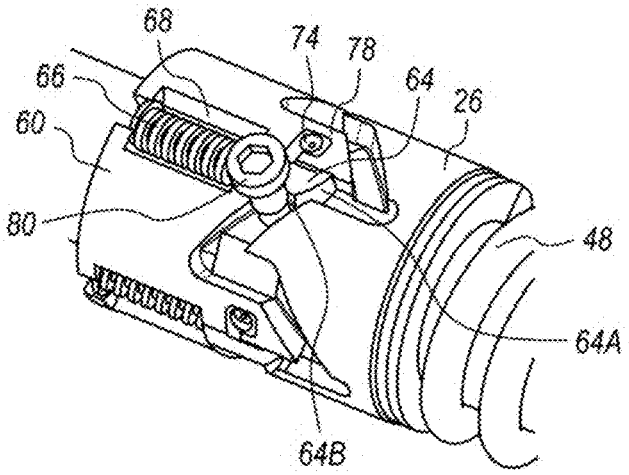
FIG. 7 is a perspective view of an embodiment of the cam portion of the piston, according to the present invention with the guide pin positioned the second pathway, showing the embodiment of the force member of FIG. 4.

FIGS. 4-8 show another feature of the slotted groove 62 as a first pathway 62B from the first point 62A to the forward contact surface 64A of the slide member 64. FIGS. 4 and 7 show the guide pin 80 at the end of the first pathway 62B with the guide pin 80 in contact with the slide member 64. Drilling fluid pressure from the surface or downward pressure exceeds a threshold to move the guide pin 80 past slide member 64. The guide pin 80 pushes the forward contact surface 64A of the slide member 64 along the slant of the forward contact surface to the edge between the forward contact surface 64A and the blocking surface 64B of the slide member 64. The force member 66 is compressed when the threshold is exceeded. The guide pin 80 in the first pathway 62B corresponds to the front outlet 30 switching from the closed position to the opened position so that the reamer blades can be extended.

Figure 8:
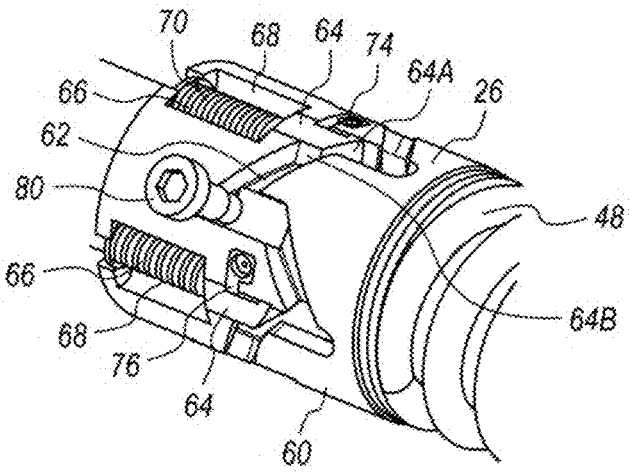
FIG. 8 is a perspective view of an embodiment of the cam portion of the piston, according to the present invention with the guide pin positioned at the second point, showing the embodiment of the force member of FIG. 4.

Embodiments of the slotted groove 62 include having a second pathway 62C from the blocking surface 64B of the slide member 64 to a second point 62D. FIGS. 3 and 8 show the guide pin 80 in the second pathway 62C and at the second point 62D corresponding to the front outlet 30 in the opened position. The reamer blades of the tool remain extended for the reaming operation at the desired downhole location. Once past the slide member 64, the threshold is reached and the guide pin 80 moves to the second point 62D without any particular pressure differential. The front outlet 30 is in the opened configuration, and the slide member 64 prevents backsliding into the first pathway 62B to close the front outlet 30. Regardless of the pressure differential being too little or not being maintained, the front outlet 30 is open. The sensitive monitoring, real time data, and surface calculations to maintain a particular pressure profile and pressure differential are no longer required to maintain the switch from closed to opened. The apparatus 10 of the present invention has a resiliency greater than prior art hydraulic control systems.

FIGS. 4-8 show the slotted groove 62 having a third pathway 62E from the second point 62D to a third point 62F. The guide pin 80 in the third pathway 62E corresponds to the front outlet 30 switching from the opened position to the closed position. Dropping pressure closes the front outlet 30 as the valve to maintain the extension of the reamer blades. The guide pin 80 at the third point 62F is analogous to the first point 62A so as to correspond to the front outlet 30 in the closed position. The guide pin 80 through the third pathway retracts the reamer blades so that the reaming operation ceases in the borehole. After the pressure threshold is passed, drilling pressure increases and decreases from the surface can more easily control the front outlet 30 and actuation of the tool, i.e. extending and retracting the reamer blades.

These features of the slotted groove 62 and components within the slotted groove are modular and repeated around the cam portion 26. The points 62A, 62D, 62F and pathways 62B, 62C, 62E are repeated around the cam portion 26. The front outlet 30 can continuously be opened and closed to extend and retract the reamer blades, just as any other downhole tool. As the piston 20 rotates within the housing 40, the front outlet 30 switches back and forth between the opened and closed configurations.

Figure 13:
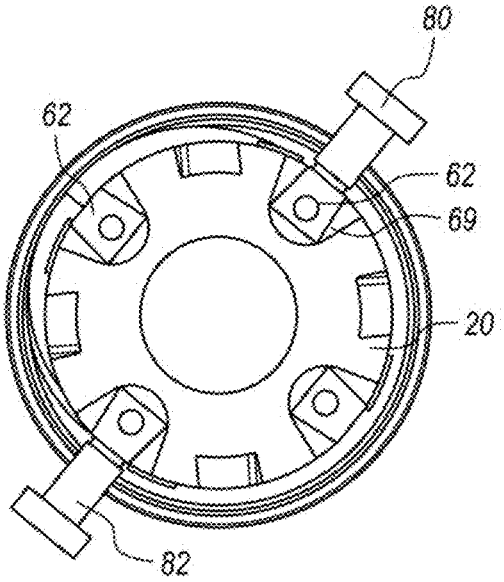
FIG. 13 is a front end sectional view of an embodiment of the piston, according to the present invention.
Figure 14:
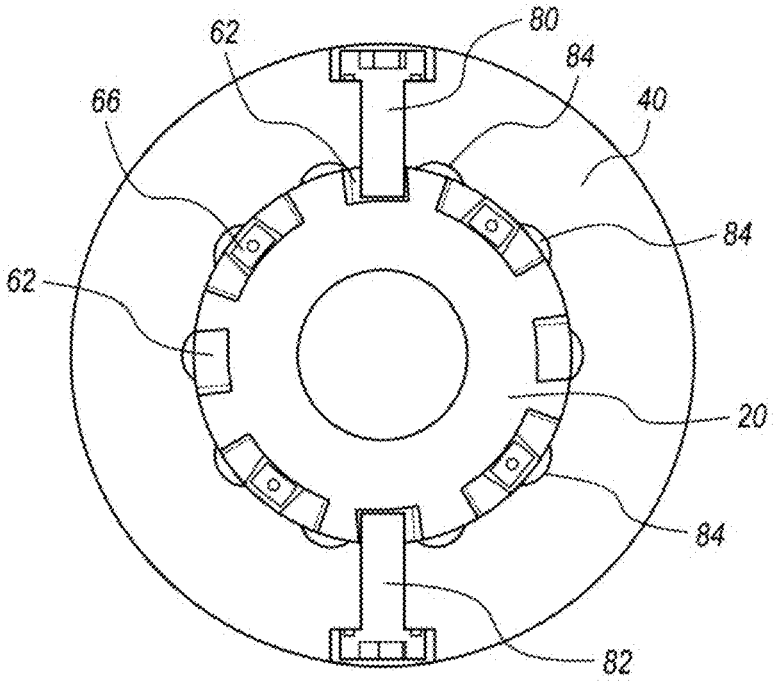
FIG. 14 is a front end sectional view of another embodiment of the apparatus, according to the present invention and including the piston and the housing with ventilation channels.

Other embodiments of the present invention include the cam portion 26 being comprised of a peripheral cavity 68, as shown in FIG. 4-8. The force member 66 is housed within the peripheral cavity 68 so as to contact the slide member 64. The slotted groove 62 of the cam portion 26 can also have a dovetail groove shape 69, as shown in FIGS. 13-14. The shape prevents the guide pin 80 and the slide member 64 from misaligning by dropping down or away from each other within the slotted groove 62. The guide pin 80 and slide member 64 cannot be misaligned within the slotted groove 62 by the different amounts of fluid pressure. The slide member 64 will not be able to move up or down within the slotted groove 62 while exerting pressure back and forth with the guide pin 80.

FIGS. 4-8 show an embodiment of the apparatus 10 comprising a locking key 74 with a locking protrusion 76 engaged to the slide member 64. The locking key 74 directs the guide pin 80 from the front contact surface 64A to the blocking surface 64B of the second pathway 62C by the slide member 64. FIGS. 4-8 show that the cam portion 26 can also be further comprised of a side cavity 78, and the locking key 74 is housed within the side cavity 78. The locking protrusion 76 extends out of the side cavity 78 to engage the slide member 64. FIGS. 4-8 show the locking protrusion 76 as a peg that engages a slot on the slide member 64. The locking protrusion 76 blocks movement of the slide member 64 so that the guide pin 80 must move into the second pathway 62C, even if the amount of pressure overcomes the force member 66. The apparatus 10 relies on a pressure threshold, not differential pressure. The locking key 74 allows the apparatus 10 to function under excessive pressure. The slide member 64 cannot be pushed so far into the force member 66 and peripheral cavity 68. Even with pressure well beyond the threshold, the slide member 64 and force member 66 will still only direct the guide pin 80 in a controlled manner from the front contact surface 64A to the blocking surface 64B and the second pathway 62C.

An alternate embodiment of the apparatus 10 is also shown in FIG. 14. The housing 40 can be comprised of a plurality of ventilation channels 84 around the cam chamber portion 56. The ventilation channels 56 provide for fluid flow between the piston 20 and the housing 40. There is less resistance to the rotational movement of the piston 20 within the housing 40 and the axial movement of the piston 20 back and forth within the housing 40. The ventilation channels 84 prevent the piston 20 from being locked in position in the housing 40.

Another alternate embodiment is shown in FIGS. 2-5, and 13-14. There can be another guide pin 82 mounted to the housing 40 and extended into the slotted groove 62 at a different position from the guide pin 80 in the slotted groove 62. FIGS. 2-5 and 13-14 show the guide pin 80 and the other guide pin 82 opposite each other. These guide pins 80, 82 and even additional guide pins (not shown) can be circumferentially dispersed around the cam chamber portion 56. The guide pins 80, 82 are also shown as being evenly distributed around the cam chamber portion 56. The number of guide pins 80, 82 are determined by the slotted groove 62. Each guide pin must be cooperative with all other guide pins within the slotted groove 62.

For example, the other guide pin 82 is around the cam chamber portion 56, while the guide pin 80 at the first point 62A corresponds to the other guide pin 82 at a respective first point within the slotted groove 62. Similarly, the guide pin 80 in the first pathway 62B corresponds to the other guide pin 82 in a respective first pathway within the slotted groove 62. The guide pin 80 at the second point 62D corresponds to the other guide pin 82 at a respective second point within the slotted groove 62. The guide pin 80 in the second pathway 62D corresponds to the other guide pin n82 in a respective second pathway within the slotted groove 62, and the guide pin 80 at the third point 62F corresponds to the other guide pin 82 at a respective third point within the slotted groove 62.

Figure 11:
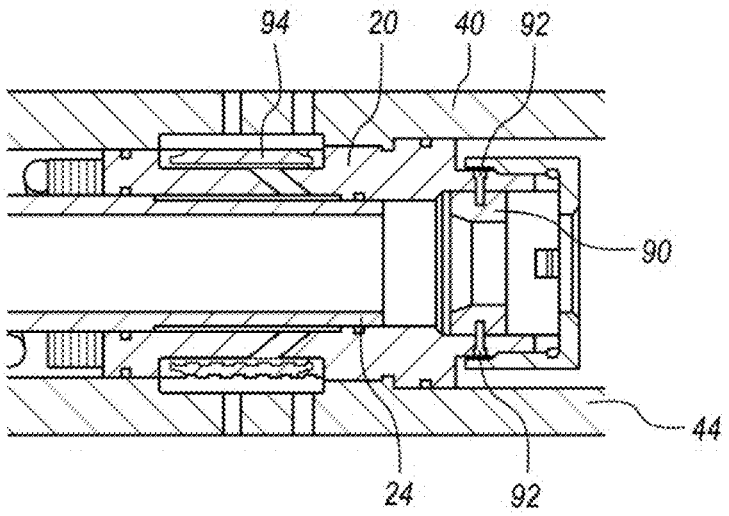
FIG. 11 is a partial sectional view of an embodiment of the lock ring in a deployed configuration relative to the piston and a filter, according to the present invention.
Figure 12:
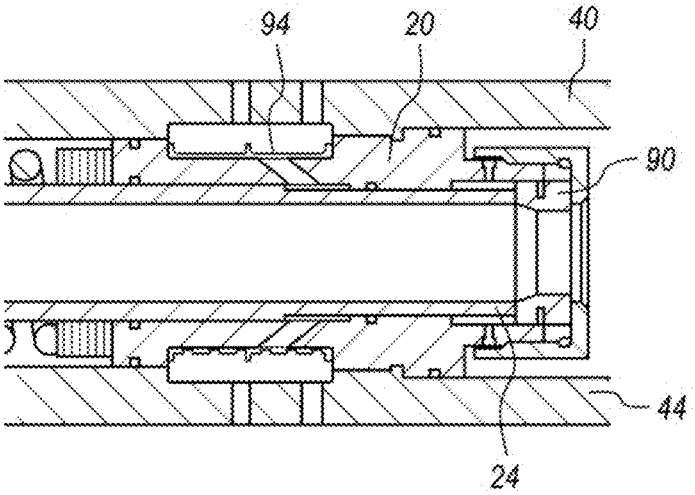
FIG. 12 is a partial sectional view of the embodiment of the lock ring in an active configuration relative to the piston, according to the present invention.

FIGS. 11-12 show additional embodiments of the apparatus 10 of the present invention. In one embodiment, there is a locking ring 90 within the second housing end 44 having a deployed configuration and an active configuration. A plurality of locking ring shear pins 92 connect the locking ring 90 to the second housing end 44 in the deployed configuration of the locking ring 90. The locking ring 90 prevents premature or accidental extension of the reamer blades. In the deployed configuration, the locking ring 90 and locking ring shear pins 92 prevent the piston 20 from moving before reaching the desired downhole location in the borehole. The front outlet 30 remains closed until the apparatus 10 reaches the desired downhole location and downhole fluid pressure is first increased over the pressure threshold that moves the guide pin 80 past the slide member 64 and shears the locking ring shear pins 92. The locking ring 90 is removably engaged to the back distal end 34 so as to shear the locking ring shear pins 92 in the active configuration. Once in the active configuration, the locking ring 90 no longer engages the piston 20. The front outlet 30 can alternate between the opened configuration and closed configuration. The piston 20 is freed to rotate and move axially back and forth within the housing 40 for the complete reaming operation.

FIGS. 11-12 also show an embodiment of the apparatus 10 further comprising a filter 94 in fluid connection with the piston 20 so as to prevent blockage of flow through the piston 20. As in FIGS. 2-3 and 11-12, the filter 94 is mounted around the back piston portion 24. The filter 94 can be cartridge type or metal wire cloth secured by a retainer or clamps. Drilling fluid can flow through the borehole, then the housing 40, then the filter 94, and then to the piston 20, in particular, the cavity of the piston 20. Sand and debris are blocked from entering this cavity or interior of the piston 20. The movement of the piston 20 is no longer affected by accumulated sand and debris.

Embodiments of the present invention include a method for activating and deactivating a downhole tool at a downhole location in a borehole. A reamer is an example of the downhole tool, and activating and deactivating corresponds to extending and retracting reamer blades. The method of the present invention includes deploying the apparatus 10 with the front outlet 30 in the closed position and the guide pin 80 at the first point 62A in the slotted groove 62 to the desired downhole location in the borehole, as shown in FIGS. 2, 4 and 5. While traveling through the borehole, the apparatus 10 will encounter both downward drilling pressure from the surface and upward annular pressure from the bottom of the borehole.

When the apparatus 10 reaches the downhole location within the borehole for the tool operation, drilling fluid pressure is applied on the cam portion 26 so as to move the guide pin 80 from the first point 62A through the first pathway 62B to the forward contact surface 64A of the slide member 64 as in FIG. 6. Then, the method includes applying the drilling fluid pressure over a pressure threshold set by the force member 66 and coil spring 48 so as to slide the guide pin 80 from the front contact surface 64A to the blocking surface 64B of the slide member 64 and into the second pathway 62 and switch the front outlet 30 from the closed position to the opened position as in FIG. 7. The coil spring 48 and the force member 66 must interact for the piston 20 to overcome the drilling fluid pressure and move the piston 20 longitudinally within the housing 40. The guide pin 80 moves through the second pathway 62C to the second point 62D with the front outlet 30 in the opened position as in FIG. 8. The front outlet 30 in the opened position allows drilling mud to flow outward to the downhole too. For the reamer example, the drilling mud flows into a chamber to push the cutter blocks or reamer blades into an extended configuration. The reaming operation commences with the reamer blades extended to engage the borehole wall and widen the borehole diameter at the downhole location.

The method further includes moving the guide pin 80 from the second point 62D through the third pathway 62E to the third point 62F so as to switch the front outlet 30 from the opened position to the closed position. With the front outlet 30 in the closed position, drilling mud no longer flows to the downhole tool. The downhole tool is turned off, when the front outlet 30 is in the closed position. For the reamer example, the lack of drilling mud empties the chamber so that the cutter blocks or reamer blades move from the extended configuration to the retracted configuration. The reamer blades no longer engage the borehole wall, so the reaming operation has stopped.

FIGS. 4-8 shows the cam portion 26 as cylindrical, and the slotted groove 62 is a continuous slotted groove 62 around the cam portion 26. The third point 62F is analogous to the next first point of the next section of the slotted groove 62. The sections are modular, so the steps of the method are repeated for opening and closing the front outlet 30. The apparatus 10 allows repeated opening and closing of the reamer blades in the example of the downhole tool as a reamer. The apparatus 10 can be turned on and off at multiple downhole locations that require tool operation, i.e. multiple downhole locations that require reaming.

The method further includes the step of applying drilling fluid pressure on the cam portion 26 with the guide pin 80 in said third point 62F as an analogous first point of next connected section of the slotted groove 62 with an analogous first pathway to an analogous forward contact surface of an analogous slide member to switch the front outlet 30 from the closed position to the opened position, and the step of applying drilling fluid pressure over the pressure threshold again so as to slide the guide pin 80 from the analogous front contact surface to an analogous blocking surface of the analogous slide member and into an analogous second pathway and switch the front outlet from the closed position to the opened position. The method also includes moving the guide pin 80 through an analogous second pathway to an analogous second point with the front outlet in the opened position. The apparatus 10 performs another downhole tool operation, i.e. another reaming operation, until needed. Then, the method includes moving the guide pin 80 from the analogous second point through an analogous third pathway to an analogous third point so as to switch the front outlet 30 from the opened position to the closed position. The steps of the method can be repeated for each modular section of the slotted groove 62.

In the embodiment of the apparatus 10 with a locking ring 90 within the second housing end 44 having a deployed configuration (FIG. 11) and an active configuration (FIG. 12), the method includes the step of deploying with the locking ring 90 in the deployed configuration. The plurality of locking ring shear pins 92 connect the locking ring 90 to the second housing end 44 in the deployed configuration of the locking ring 90 so as to prevent premature or accidental extension of the reamer blades. In the deployed configuration, the locking ring 90 and locking ring shear pins 92 prevent the piston 20 from moving before reaching the desired downhole location in the borehole. Concurrent with the first time that the method includes applying the drilling fluid pressure over a pressure threshold so as to slide the guide pin 80 from the front contact surface 64A to the blocking surface 64B of the slide member 64 and into the second pathway 62 and switch the front outlet 30 from the closed position to the opened position, the method can further comprising the step of shearing the plurality of locking ring shear pins 92 and setting the locking ring 90 in the active configuration from the deployed configuration. Once in the active configuration, the locking ring 90 no longer engages the piston 20 and longer is involved in subsequent and repeated alternating of the front outlet 30 between the opened configuration and closed configuration. The piston 20 is freed to rotate and move axially within the housing 40 for the complete reaming operation.

In the embodiment of the apparatus 10 with a locking key 74 having a locking protrusion 76 engaged to the slide member 64, the step of applying drilling fluid pressure over the pressure threshold further comprises the step of directing the guide pin 80 from the front contact surface 64A to the blocking surface 64B of the second pathway 62C by the slide member as set by the locking key 74. The locking key 74 holds the position of the slide member 64 so that the guide pin 80 deflects from the front contact surface 64A to the blocking surface 64B before pushing further against the front contact surface 64A.

The method includes embodiments of the step of moving the guide pin 80 through the second pathway 62C to the second point 62D being comprised of applying drilling fluid pressure greater than annual pressure. The method further includes embodiments of the step of moving the guide pin 80 from the second point 62D through the third pathway 62E to the third point 62F being comprised of applying annular pressure greater than drilling fluid pressure. The method of the present invention is no longer reliant on pressure differential for steering through a complete slotted groove with different branches.

There is a need for a different hydraulic control system and method. A pressure differential is complicated and difficult to maintain. The ability to change the drilling pressure as pumped from the surface is the most reliable control, but the annular pressure of the backflow from the bottom of the borehole is must less predictable and stable. With the complex slotted tracks with big curvature, small curvatures, widened track width, and recesses, the navigation of the guide pin requires a high level of data collection, data processing, and sensitivity.

The present invention provides a hydraulic or fluid control system for repeatedly activating and de-activating a downhole tool, such as a reamer. Instead of reliance precise monitoring and manipulation of downhole drilling pressure and annular pressure to maintain particular differential pressures, the hydraulic control system of the present invention activates and de-activates a downhole tool by a pressure threshold. The fluid control system includes a cam portion with a slotted groove and a force member within the slotted groove. The force member allows the system to control the activation of the tool by a pressure threshold, instead of the delicate pressure differential navigation through a complex branched groove of the prior art. The embodiments of the present invention further include a slide member interactive with the force member to direct the guide pin within the slotted groove. The slide member protects the force member from damage. Each component is separately replaceable, if damaged. There can also be a stop member to ensure that the slide member directs the guide pin against the force member within the slotted groove.

The slotted groove of the present invention can also have a dovetail shape to prevent the slide member and guide pin from dropping away from each other or misaligning within the slotted groove. There can also be ventilation channels in the housing around the cam portion. The control system of the present invention can include a lock ring to prevent accidental rotation and movement of the cam portion during deployment into the borehole. The front outlet can be comprised of an elongated slot, a slide rod removably extended into the elongated slot in the opened position, and a die spring connected to the slide rod so as to determine an activation pressure range. The present invention can activate and maintain the reaming activation at different ranges of pressure, including low pressures that would protect weak rock formations of the borehole.

The foregoing disclosure and description of the invention is illustrative and explanatory thereof. Various changes in the details of the illustrated structures, construction and method can be made without departing from the true spirit of the invention.

We claim:

1. A hydraulic control apparatus for activating and deactivating a downhole tool at a downhole location in a borehole, comprising:

a piston being comprised of a front piston portion, a back piston portion opposite said front piston end, and a cam portion between said front piston portion and said back piston portion, wherein said front piston portion has a front distal end with a front outlet with an opened position and a closed position, and wherein said back piston portion has a back distal end;

a housing having a first housing end, a second housing end opposite said first housing end, and an interior chamber between said first housing end and said second housing end, wherein said cam portion, said back piston portion, and at least a portion of said front piston portion are contained within said interior chamber, wherein said interior chamber has a front chamber portion, a back chamber portion opposite said front chamber portion, and a cam chamber portion between said front chamber portion and said back chamber portion, said front piston portion being moveable within said front chamber portion and said cam chamber portion, said cam portion being moveable within said cam chamber portion, said back piston portion being moveable within said back chamber portion and said cam chamber portion a coil spring around said back piston portion and in contact with said cam portion so as to exert pressure back and forth against cam portion, wherein said cam portion is comprised of an outer cam surface, a continuous slotted groove along said outer cam surface so as to circumscribe said cam portion, a slide member within the slotted groove, and a force member in contact with said slide member so as to exert back and forth between said force member and said slide member, and wherein said slide member has a forward contact surface and a blocking surface adjacent said forward contact surface; and a guide pin mounted to said housing and extended into the slotted groove, wherein the slotted groove has a first point, wherein said guide pin at said first point corresponds to said front outlet in said closed position, wherein the slotted groove has a first pathway from said first point to said forward contact surface of said slide member, wherein said guide pin in said first pathway corresponds to said front outlet switching from said closed position to said opened position, wherein the slotted groove has a second pathway from said blocking surface of said slide member to a second point, wherein said guide pin in said second pathway and at said second point corresponds to said front outlet in said opened position, wherein the slotted groove has a third pathway from said second point to a third point, wherein said guide pin in said third pathway corresponds to said front outlet switching from said opened position to said closed position, and wherein said guide pin at said third point is analogous to said first point so as to correspond to said front outlet in said closed position.

2. The hydraulic control apparatus, as in claim 1, wherein said cam portion is further comprised of a peripheral cavity, said force member being housed within said peripheral cavity so as to contact said slide member.

3. The hydraulic control apparatus, as in claim 1, wherein said force member is comprised of a spring.

4. The hydraulic control apparatus, as in claim 1, wherein said front outlet is comprised of an elongated slot, a slide rod removably extended into said elongated slot in said opened position, and a die spring connected to said slide rod so as to determine an activation pressure range of said front outlet.

5. The hydraulic control apparatus, as in claim 1, wherein said housing is comprised of a plurality of ventilation channels around said cam chamber portion so as to allow fluid flow between said piston and said housing.

6. The hydraulic control apparatus, as in claim 1, wherein the slotted groove has a dovetail groove shape so as to prevent said guide pin and said slide member from misalignment within the slotted groove.

7. The hydraulic control apparatus, as in claim 1, further comprising:

a locking key having a locking protrusion engaged to said slide member so as to direct said guide pin from said front contact surface to said blocking surface of said second pathway by said slide member.

8. The hydraulic control apparatus, as in claim 7, wherein said cam portion is further comprised of a side cavity, said locking key being housed within said side cavity.

9. The hydraulic control apparatus, as in claim 1, further comprising:

another guide pin mounted to said housing and extended into the slotted groove, said another guide pin being around said cam chamber portion, wherein said guide pin at said first point corresponds to said another guide pin at a respective first point within the slotted groove, wherein said guide pin in said first pathway corresponds to said another guide pin in a respective first pathway within the slotted groove, wherein said guide pin at said second point corresponds to said another guide pin at a respective second point within the slotted groove, wherein said guide pin in said second pathway corresponds to said another guide pin in a respective second pathway within the slotted groove, and wherein said guide pin at said third point corresponds to said another guide pin at a respective third point within the slotted groove.

10. The hydraulic control apparatus, as in claim 9, wherein said another guide pin and said guide pin are circumferentially dispersed around the cam chamber portion.

11. The hydraulic control apparatus, as in claim 1, further comprising:

a locking ring within said second housing end having a deployed configuration and an active configuration; and a plurality of locking ring shear pins connecting said locking ring to said second housing end in said deployed configuration.

12. The hydraulic control apparatus, as in claim 11, wherein said locking ring is removably engaged to said back distal end so as to shear said locking ring shear pins in said active configuration.

13. The hydraulic control apparatus, as in claim 1, further comprising:

a filter in fluid connection with said piston so as to prevent blockage of flow through said piston.

14. A method for activating and deactivating a downhole tool at a downhole location in a borehole, comprising the step of:

deploying the apparatus of claim 1 with said front outlet in said closed position and said guide pin at said first point in the slotted groove to the downhole location in the borehole;

applying drilling fluid pressure on said cam portion so as to move said guide pin from said first point through said first pathway to said forward contact surface of said slide member;

applying drilling fluid pressure over a pressure threshold so as to slide said guide pin from said front contact surface to said blocking surface of said slide member and into said second pathway and switch said front outlet from said closed position to said opened position;

moving said guide pin through said second pathway to said second point with said front outlet in said opened position; and moving said guide pin from said second point through said third pathway to said third point so as to switch said front outlet from said opened position to said closed position.

15. The method for activating and deactivating, according to claim 14, wherein the apparatus further comprises a locking ring within said second housing end having a deployed configuration and an active configuration, and wherein said locking ring is in said deployed configuration during the step of deploying.

16. The method for activating and deactivating, according to claim 14, wherein the apparatus further comprises a locking key having a locking protrusion engaged to said slide member, and wherein the step of applying drilling fluid pressure over said pressure threshold further comprises the step of directing said guide pin from said front contact surface to said blocking surface of said second pathway by said slide member.

17. The method for activating and deactivating, according to claim 14, wherein the step of moving said guide pin through said second pathway to said second point is by drilling fluid pressure being greater than annual pressure.

18. The method for activating and deactivating, according to claim 14, wherein the step of moving said guide pin from said second point through said third pathway to said third point is by annular pressure being greater than drilling fluid pressure.

19. The method for activating and deactivating, according to claim 14, wherein the apparatus further comprises:

a locking ring within said second housing end having a deployed configuration and an active configuration, and a plurality of locking ring shear pins connecting said locking ring to said second housing end in said deployed configuration, and wherein the step of applying drilling fluid pressure over said pressure threshold further comprises the steps of:

shearing said plurality of locking ring shear pins, and setting said locking ring in said active configuration from said deployed configuration.

20. The method for activating and deactivating, according to claim 14, further comprising the steps of:

applying drilling fluid pressure on said cam portion with said guide pin at said third point as an analogous first point of a next connected section of the slotted groove with an analogous first pathway to an analogous forward contact surface of an analogous slide member;

applying drilling fluid pressure over the pressure threshold so as to slide said guide pin from the analogous front contact surface to an analogous blocking surface of the analogous slide member and into an analogous second pathway and switch said front outlet from said closed position to said opened position;

moving said guide pin through an analogous second pathway to an analogous second point with said front outlet in said opened position; and moving said guide pin from the analogous second point through an analogous third pathway to an analogous third point so as to switch said front outlet from said opened position to said closed position.

* * * * *